United States Patent [19]

Griese et al.

[11] 3,969,583

[45] July 13, 1976

[54] METHOD OF STEREOPHONIC RECORDING

[75] Inventors: Hans-Joachim Griese, Isernhagen; Paul-Friedrich Warning; Klaus-Hinrich Wichmann, both of Mellendorf, all of Germany

[73] Assignee: Sennheiser Electronic, Bissendorf, Hannover, Germany

[22] Filed: Apr. 16, 1974

[21] Appl. No.: 461,366

[30] Foreign Application Priority Data

Mar. 2, 1974 Germany ..... 2410146

[52] U.S. Cl. ..... 179/1 G; 179/100.1 TD

[51] Int. Cl.[2] ..... H04R 5/00

[58] Field of Search ..... 179/1 G, 15 BT, 1 GP, 179/1 AT, 156 R, 100.4 ST, 100.1 TD

[56] References Cited

UNITED STATES PATENTS 2,481,911 9/1949 De Boer et al. ..... 179/1 G 3,789,164 1/1974 Ryder ..... 179/156 R

OTHER PUBLICATIONS

Binaural or Stereophonic?, by R. J. Tinkham, Audio Engineering, Jan. 1953, pp. 22–24, 57.

Stereo Illusion, by J. D. Harris, Electronics World, Oct. 1959, pp. 37–40.

*Primary Examiner*—Kathleen H. Claffy
*Assistant Examiner*—George G. Stellar

[57] ABSTRACT

An improved technique for recording by means of head-mounted stereophonic microphones is described. The microphones are disposed for detecting waves from a sound source at a reference location within the ears of the listener corresponding to a position slightly in front of the ear canal at which reproduction of sound via earphones is optimum. The long-term storage effects provided by the brain of the person doing the recording are reproduced on the recording to provide a high degree of realism.

6 Claims, 5 Drawing Figures

MICROPHONE RESPONSE

RESPONSE OF SET OF EARPHONES

METHOD OF STEREOPHONIC RECORDING

BACKGROUND OF THE INVENTION

The invention relates to a method of stereophonic recording wherein sound waves are detected by head-mounted stereophonic microphones in a pair of actual or simulated human ears, and the electrical signals at the microphone outputs are recorded, e.g., on a stereophonic tape recorder.

In the technique of "artificial head" stereophony, a head formed from plastic or other synthetic material and having ears whose acoustic characteristic simulate that of a particular human model is employed at a pick-up location, e.g., in a concert hall. The resulting sound pressure produced in the ear canals of the artificial head is recorded via a pair of correspondingly located stereophonic microphones.

This technique has been found to be subject to inaccuracies when a listener hearing the resulting record attempts to orient himself with respect to the original source of the sound, particularly within certain angular ranges. More important, since the acoustic frequency response of a human head to sound waves includes a long-term storage and correction aspect supplied by the brain by which each person receives sound impressions in a particular way, stereophonic recording employing an artificial head cannot approach the realism of the original sound source to the listener. This is particularly important in the field of amateur stereophonic recording where the reproduction is primarily desired for the subjective enjoyment of the original person doing the recording.

Such lack of realism is augmented by the fact that although the reference location in normal recording microphones is within the ear canal itself, the ideal reference position for known types of reproduction apparatus, particularly earphones, is slightly outside the ear canal. This relative displacement in reference points leads to distortion during the reproduction of the stereophonic recording by a human listener wearing head-mounted earphones in the usual manner. One reason for such distortion is the unavoidable shaping of the frequency characteristics of the sound waves by the impedance of the ear canal during the recording operation, and is aggravated by the use of elongated sound guides commonly used in known recording apparatus.

Additionally, since the acoustic characteristics of human ears are extremely varied, a recorded pick-up by an artificial head designed to match a particular human model will generally lead to distortion when the recording is played back in the ears of humans having dissimilar acoustic characteristics.

SUMMARY OF THE INVENTION

An improved technique of stereophonic recording for avoiding these disadvantages is provided by the method of the present invention which employs head-mounted stereophonic microphones. In one embodiment, a pair of sterophonic microphones are rigidly supported in a pair of natural or simulated human ears for recording sound pressures at reference locations corresponding to the point of optimum placement of open earphones during reproduction. Such reference points may advantageously be about 10 mm in front of the entrance to the ear canal, so that the impedance of the ear canal has minimal effect on the directivity of the pick-up, and permits accurate orientation of the original sound source during reproduction with the earphones. At such location the acoustic characteristics of a wide range of listeners are effectively averaged.

Moreover, when the recording itself is done by a human being outfitted with the inventive arrangement, the resulting sound signals are subject to undistorted long-term storage effects from that person's brain for added realism during playback.

The microphones may illustratively include a pair of condenser microphone crystals individually mounted in casings that are connected together via an elastic chinstrap or other head mounting.

In one feature of the invention, the microphones have active dimensions which are made small with respect to the shortest wavelength of the received sound waves. Such microphones are advantageously secured in the desired reference position of the listener's ears by means of the combination of the elasticity of the chinstrap and the use of projections disposed on the microphone capsules for insertion in the incisura intertragia of the ear.

BRIEF DESCRIPTION OF THE DRAWING

The invention will be further set forth in the following detailed description taken in conjunction with the appended drawing, in which.

DETAILED DESCRIPTION

Figure 1:
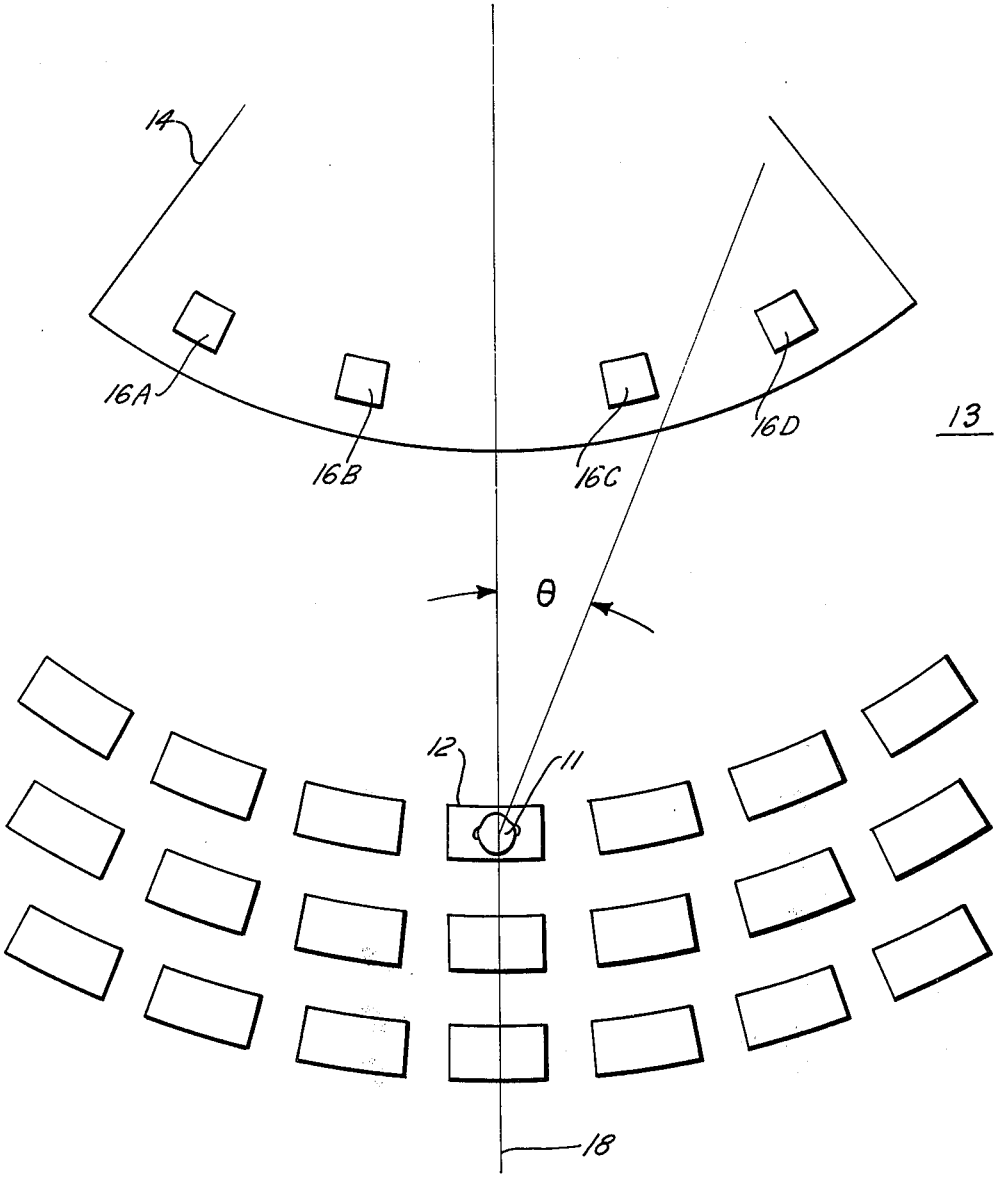
FIG. 1 is a pictorial representation of a concert hall showing a typical location of a human listener outfitted with a head-mounted stereophonic microphone assembly for recording by the technique of the invention.

Referring now to the drawing, FIG. 1 shows pictorially an arrangement illustrating the technique in accordance with the invention for improved stereophonic recording. A human listener 11 is pictorially depicted as seated at a prescribed location 12 in concert hall 13. The listener 11 is oriented with respect to a stage 14 so that sound waves to be recorded originate from a plurality of sources 16*a*, 16*b*, 16*c* and 16*d* to individually reach the listener's ears. The reference orientation of the listener's head during such recording is assumed to be in an aligned position with a reference axis 18. A typical set of frequency response curves corresponding to a plurality of representative listeners to sound waves emanating at various angles are given at page 468 of the Journal of the Acoustical Society of America, Vol. 39, No. 3 (1966).

Figure 2:
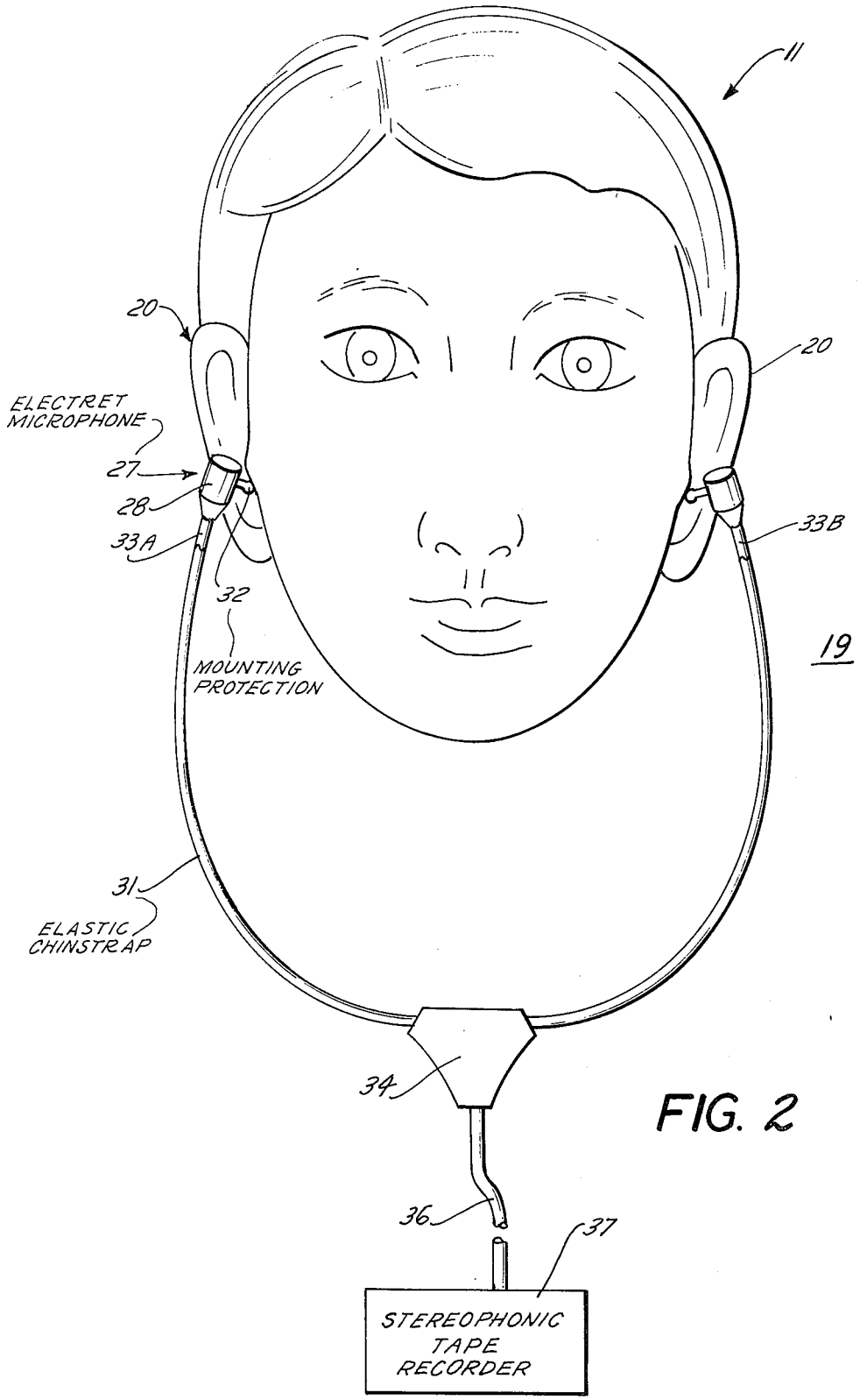
FIG. 2 is a representation of a complete recording apparatus worn by the human listener referred to in FIG. 1.

As shown best in FIG. 2, the listener 11 is outfitted with a head-mounted microphone assembly 19 for recording the sound impinging on the ears represented at 20. The microphone assembly 19 may be of the type marketed under the Sennheiser trade designation MKE 2002. Each ear 20 has an ear canal 22 (FIG. 3) which opens out on a forward area 23 of the ear i.e. the cavun conchae. The forward area 23 is bounded at the front and the back by a tragus 24 and an antitragus 26, respectively. The forward area 23 receives one of a pair of stereophonic microphones 27 of the assembly 19. Each such microphone 27 is disposed within a casing 28 with a sound input 29 thereof located in the forward area 23 of the ear. Preferably each microphone 27 is so disposed that the midpoint of the sound inlet 29 lies at a prescribed reference point outside the entrance to the ear canal irrespective of the particular acoustic response of the ear 20. Such reference point is chosen to correspond to the optimum position of the location of an earphone worn by a human listener during the playback of the recording being described. In particular, a location approximately 10 mm outside the entrance of the ear canal has been found to be optimum in practice.

Each microphone 27 illustratively includes highly sensitive condenser microphone crystals carried in the casing 28. Such crystals advantageously have an electret polarization characteristic to permit a small physical embodiment of the microphone and further have a spherical directivity characteristic.

Referring again to FIG. 2, the casings 28 for the respective ears 20 are interconnected by an elastic chinstrap 31, which may be of the general type employed in stethoscopes. The pressure applied by the elasticity of the strap 31, together with a frictional grip provided in the incisura intertragia of the ear by a projection 32 extending from each of the casings 28 are effective to rigidly suspend the associated microphone 27 at the chosen reference points of the ear in a relatively simple way.

A pair of output cables 33*a* and 33*b* extend from the outputs of the microphones 27 and within the chinstrap 31 to a receptacle 34 where they are connected with a feed cable 36. The cable 36 is routed to the dual inputs of a conventional stereophonic tape recorder 37.

Preferably the mechanical dimensions of each microphone 27 are made small compared to the shortest wavelength of the sound frequency to be detected to avoid additional distortions in the recording.

Figure 4:
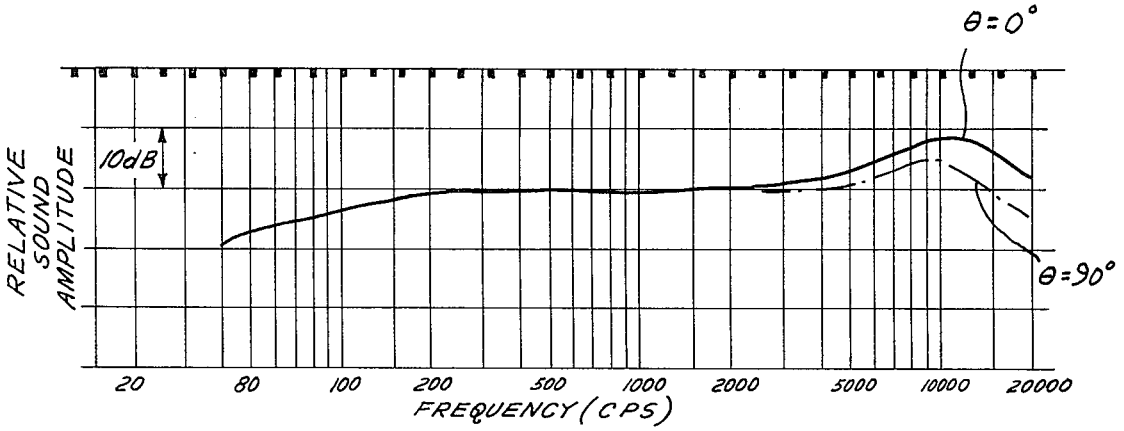
FIG. 4 is a set of curves showing a typical frequency response of a stereophonic microphone suitable for carrying out the method of the invention.
Figure 5:
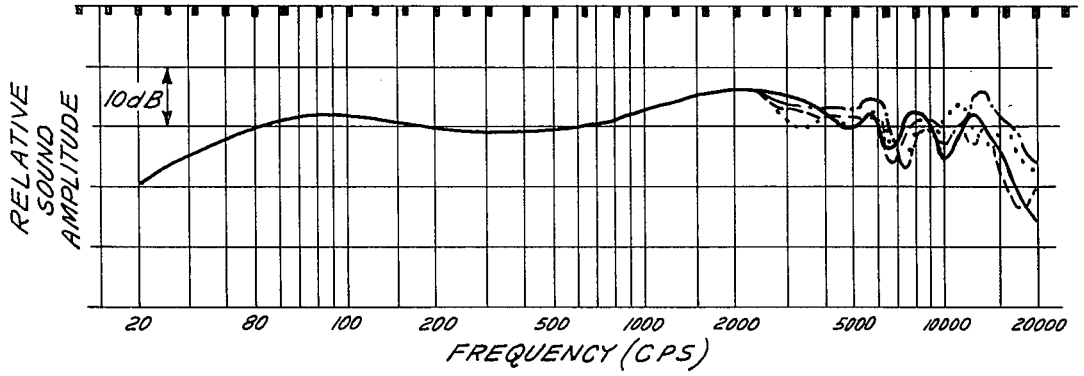
FIG. 5 is a set of curves showing the frequency response of a set of earphones suitable for playing back a stereophonic recording effected by the technique of the invention.

The process in accordance with the invention wherein the pick-up points of the stereophonic microphones 27 during recording are disposed in front of the ear canal rather than inside it as in prior arrangements has been found to greatly enhance the quality of sound reproduction over earphones during playback and to greatly improve the ability of the listener to orient himself in the direction of the original sound source. With this arrangement, the combination of the acoustic characteristics of the listener's ears and the response characteristics of the microphone 27 (shown, e.g., in FIG. 4) yield an optimum stereophonic recording. During playback of such recording with suitable earphones disposed at the above-mentioned reference points in a listener's ears, a high-fidelity reproduction is obtained. Such earphones, which are not specifically illustrated, may be similar to those marketed under the Sennheiser trade designation HD 424 and typically have the response characteristics shown in FIG. 5.

Figure 3:
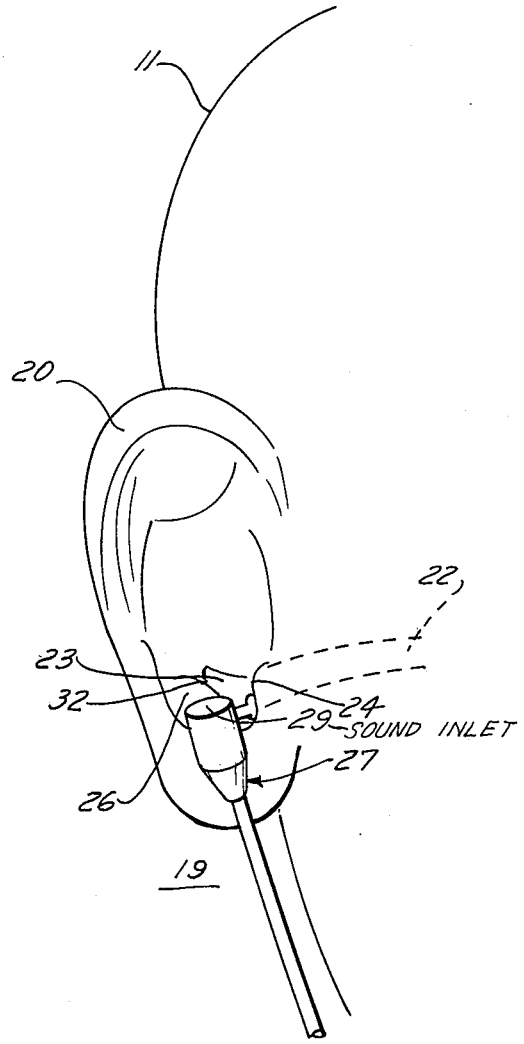
FIG. 3 is a more detailed pictorial representation of one portion of the apparatus of FIG. 2 associated with one ear of the listener.

The technique of the invention is advantageous when either a natural person's head or an artificial head is used for recording. For example, during the recording of a suitable sound program by a live human listener as shown in FIGS. 1, 2 and 3, the total frequency response of the listener to the sound waves picked up by the microphones 27 at the specified reference points in his ears contain components which represent long-term storage and correction effects in his brain. Because of the addition of such subjective components, the playback of the resulting recording will be augmented in realism, (particularly to the listener who originally recorded it), in a manner that is impossible to obtain employing other recording techniques.

Alternatively, when the microphones 27 are located in the specified reference points in an artificial head during recording, such recording will not be dependent on the special and peculiar transmission characteristics of a particular set of ears (namely those of the model used for such artificial head), but instead on a characteristic which corresponds to the average of many hearing models; this leads again to an enhanced reproduction quality of the playback.

In the foregoing, the method of the invention has been described in connection with a preferred manner of operation. Many variations and modifications of such method will now occur to those skilled in the art. It is accordingly desired that the scope of the appended claims not be limited to the specific disclosure herein contained.

What is claimed is:

1. In a method of stereophonic recording wherein sound waves are detected by a pair of head-mounted stereophonic microphones individually disposed within a pair of actual or simulated human ears and wherein the detected sound waves are recorded, the improvement which comprises the step of locating the sound inlet of each microphone at prescribed reference points disposed in front of the entrance to the ear canal.

2. In a method of stereophonic recording wherein sound waves are detected by a pair of head-mounted stereophonic microphones and wherein such detected sound waves are recorded, the improvement which comprises the step of locating the sound inlets of each microphone within the ears of a human listener at prescribed reference points disposed in front of the entrance to the ear canal.

3. The improved method as defined in claim 2, in which the detecting step is carried out with stereophonic microphones whose active dimensions are small compared to the shortest wavelength of the sound waves to be recorded.

4. The improved method as defined in claim 2, further comprising the step of supporting the microphones on respectively opposite ends of an elastic chinstrap to support the microphones in the operative position within the ears of the listener.

5. The improved method as defined in claim 2, in which each reference point is disposed approximately 10mm outside the entrance of the associated ear canal.

6. The improved method as defined in claim 2, in which the recording step is carried out with stereophonic condenser microphones.

* * * * *